US005947789A

United States Patent [19]

Chan

[11] Patent Number: 5,947,789

[45] Date of Patent: Sep. 7, 1999

[54] TOY SWORD HAVING A VARIABLE COLOR ILLUMINATED BLADE

[75] Inventor: Albert T. W. Chan, Markham, Canada

[73] Assignee: Thinkway Trading Corporation, Markham, Canada

[21] Appl. No.: 08/901,626

[22] Filed: Jul. 28, 1997

[51] Int. Cl.[6] ..... A63H 33/22

[52] U.S. Cl. ..... 446/219; 446/473; 446/485; 362/277

[58] Field of Search ..... 446/219, 473, 446/485; 362/277, 268, 335

[56] References Cited

U.S. PATENT DOCUMENTS

| | | | |
|---|---|---|---|
| 4,120,116 | 10/1978 | Williams | 446/219 |
| 4,338,654 | 7/1982 | Logothetis | 362/268 |
| 4,678,450 | 7/1987 | Scolari et al. | 446/473 |
| 4,904,222 | 2/1990 | Gastgeb et al. | 446/473 |
| 5,105,343 | 4/1992 | Wakimoto | 362/277 |
| 5,145,446 | 9/1992 | Kuo | 446/473 |
| 5,279,513 | 1/1994 | Connelly | 446/219 |
| 5,321,591 | 6/1994 | Cimock et al. | 446/473 |

FOREIGN PATENT DOCUMENTS

| | | | |
|---|---|---|---|
| 530990 | 3/1993 | European Pat. Off. | 446/219 |
| 3429223 | 1/1986 | Germany | 446/219 |
| 2199256 | 7/1988 | United Kingdom | 446/473 |
| 2221626 | 2/1990 | United Kingdom | 446/219 |

*Primary Examiner*—Robert A. Hafer
*Assistant Examiner*—Jeffrey D. Carlson
*Attorney, Agent, or Firm*—Alex Porat; Brian W. Gray; Blake, Cassels & Graydon

[57] ABSTRACT

A toy sword featuring a handle section and a translucent blade section. The handle section houses a light source for illuminating an interior of the blade section. A switch energizes the light source. A translucent multi-colored object, such as a segmented, multicolored disk, is disposed to substantially filter the color of the light illuminating the blade interior. The multi-colored object is mounted in a cage to preclude it from grossly deviating out of the path of the light illuminating the blade interior, but the multi-colored object is free to float within the cage such that natural parrying and thrusting motion of the toy sword in play varies the color of the light illuminating the blade section and increases the excitement of sword play.

12 Claims, 6 Drawing Sheets

TOY SWORD HAVING A VARIABLE COLOR ILLUMINATED BLADE

FIELD OF INVENTION

The invention relates to toy swords, and more particularly to a toy sword having a lighted or illuminated blade wherein the color of the light which illuminates the blade varies from time to time.

BACKGROUND OF INVENTION

Toy swords, formed, for example, from plastic material, have been commercially available to delight children in fictitious sword play for many years. One particular example of such a toy sword is the Thunder Sword™m, manufactured and marketed by Thinkway Toys, Ltd., of Markham, Ontario, Canada.

The Thunder Sword™ features an opaque handle section and a translucent blade section. The sword also includes switches which trigger certain visual and acoustic effects produced by electronic circuitry housed within the handle of the sword. For example, in one mode of operation, waving or otherwise agitating the sword causes a motion actuated switch embedded in the sword to momentarily close. The motion actuated switch, in turn, triggers the electronic circuitry to produce a sound resembling the noise of thunder. The motion actuated switch is also operative to energize a light source, housed in the handle, in order to illuminate the interior of the blade during use. Other switches, disposed on the handle, can also trigger these effects when actuated. The aural and visual effects add a certain excitement to using the sword, particularly in a darkened room where the sword can resemble a thundering "light sabre" whenever the appropriate switches are actuated.

The present invention seeks to improve upon the excitement generated by the visual effects in such toy swords having lighted or illuminated blades. More particularly, the invention seeks to provide a toy sword having a blade which is (a) illuminated by light of varying color and (b) wherein the visual effects are actuated by the natural thrusting and parrying motions of sword play. It is also desired to effect these improvements and enhancements to the visual experience in sword play in a most cost effective manner.

SUMMARY OF INVENTION

Broadly speaking, the invention provides a toy sword having a handle section and a translucent blade section. The handle section houses a light source for producing a beam of light directed into the blade section. A translucent, multi-colored object is disposed proximate to the light source and substantially in the path of the light beam. Means are provided for constraining the multi-colored object in order to prevent it from grossly deviating out of the path of the light beam. At the same time, the constraining means enable the multi-colored object to freely float and vary its orientation whenever the toy sword is agitated. In this manner, the color of the light illuminating the interior of the blade is varied whenever the sword is shaken or agitated. Means are also provided for energizing the light source.

In the preferred embodiment, the translucent multi-colored object is a disk featuring a plurality, preferably three (3), of substantially equally sized disk segments of different colors. The disk is disposed substantially normal to or transverse of the light beam and is sized larger than, preferably in a range of about 25% to 100% larger than, a cross-sectional area of the light beam at that point. The constraining means preferably comprises an upper surface of an assembly used to mount a light bulb in the handle of the sword, which surface includes a plurality of projecting pins that define an area sized a little larger than the multi-colored disk. A cover plate is mounted to the pins. The cover plate has an opening sized to permit the light beam to shine through the cover but smaller than the size of the disk. The multi-colored disk is sandwiched between the top surface of the assembly and the cover, but is otherwise free to spin and translate for a limited distance in a plane defined by the pins. In the preferred embodiment, there are four (4) such pins that define a rectangular shape which, when concentric with the disk, has a diagonal larger than the diameter of the disk and sides which are smaller than the diameter of the disk.

In an alternative embodiment, the translucent multi-colored object is a translucent sphere having at least one hemisphere thereof segmented into substantially equally sized segments of different colors. The constraining means are similar, except that the pins are much larger, i.e. posts, which define a volume sufficiently large enough to enable the sphere to freely rotate therein.

BRIEF DESCRIPTION OF THE DRAWINGS

The preferred embodiment of the invention is herein described, by way of non-limiting example only, with reference to the accompanying drawings, wherein.

DETAILED DESCRIPTION OF PREFERRED EMBODIMENTS

Figure 1:
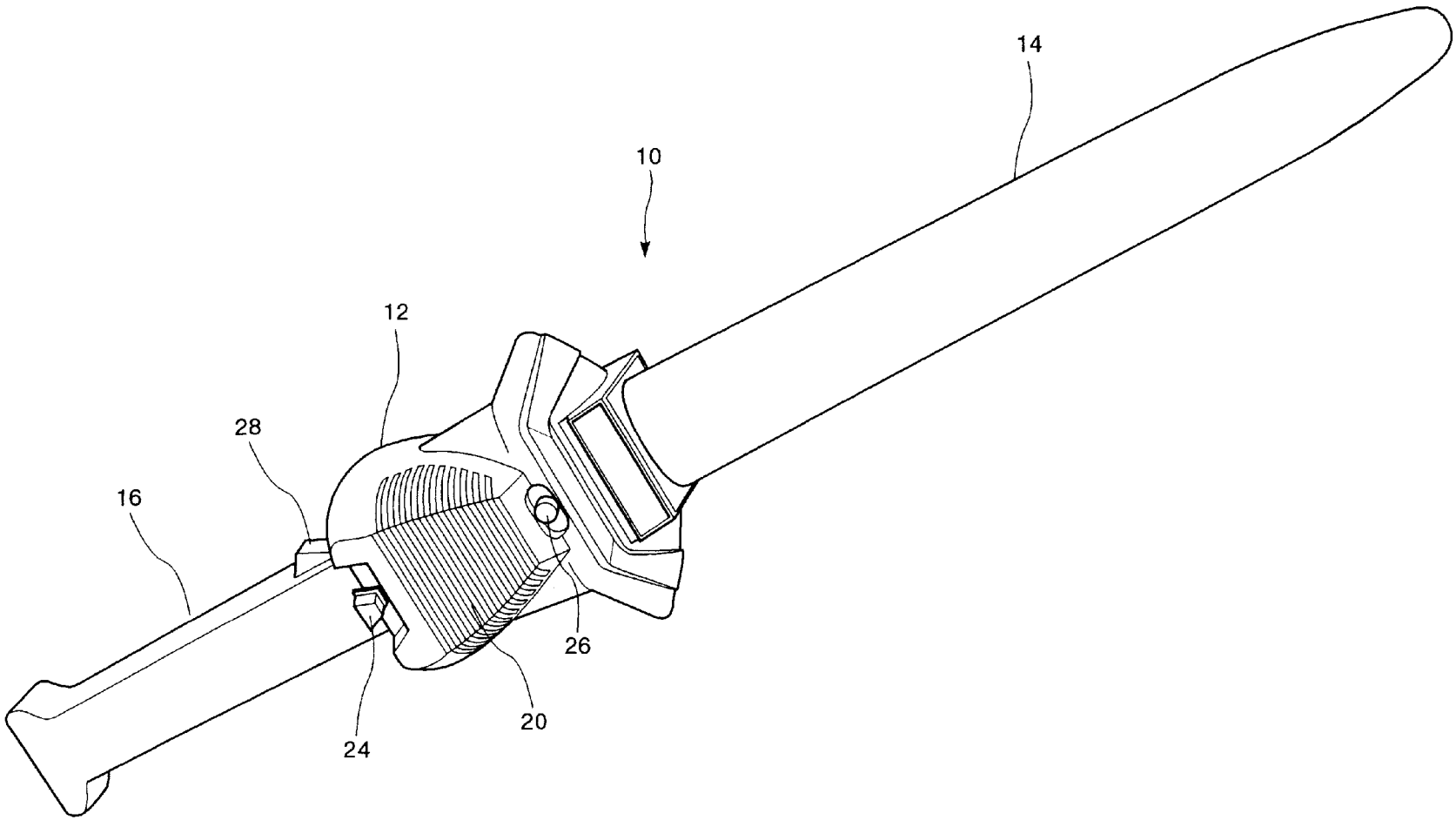
FIG. 1 is an axonometric projection of a toy sword in accordance with a preferred embodiment of the invention.

FIG. 1 depicts the Thunder Sword™ to which the improvement of the invention has been applied. It will be understood that the Thunder Sword™ is only representative of toy swords having lighted or illuminated blades and the invention may be applied to other designs of toy swords having lighted or illuminated blades.

The sword 10 shown in FIG. 1 comprises a handle section 12 and a blade section 14. The handle section 12 is opaque and is suitably designed to provide a hand grip 16 and house electronic circuitry 18, including a speaker 20, (see also FIG. 5). The blade section 14 is translucent. For the purposes of this specification, the term "translucent" means the condition of light passing through an object without distortion, i.e., transparently, and the condition of light passing through an object diffusely, i.e., semi-transparently. In the most preferred embodiment the blade section 14 is translucent in the sense of "light passing through diffusely", in order to provide a blade section which conveys the impression of being a solid piece as opposed to a clear, transparent plastic blade section that one can see right through.

The sword 10 also includes a number of control switches thereon. Switch 24 is an on/off and mode switch, as described in greater detail below. Switches 26 and 28 are dedicated momentary contact switches, whose purpose will be described in greater detail below.

Figure 2:
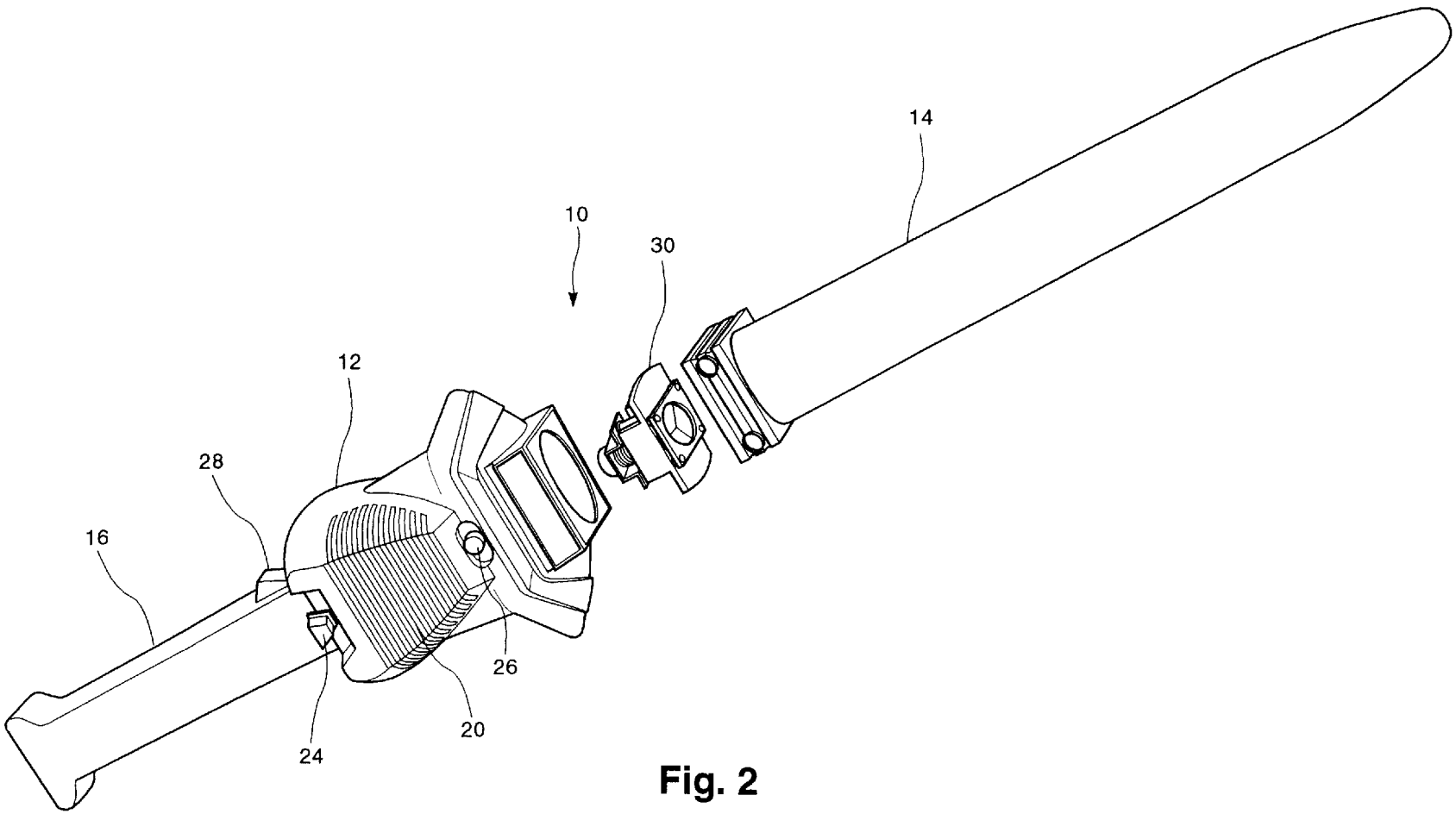
FIG. 2 is a partially exploded axonometric projection of the toy sword of FIG. 1 showing an internal assembly, in accordance with the preferred embodiment, which provides variable color light for illuminating the blade of the sword.

FIG. 2 shows, in an exploded view, an internal assembly 30 which is mounted in the handle section 12 of the sword 10. The internal assembly 30 houses a light source for illuminating the interior of blade section 14.

Figure 3:
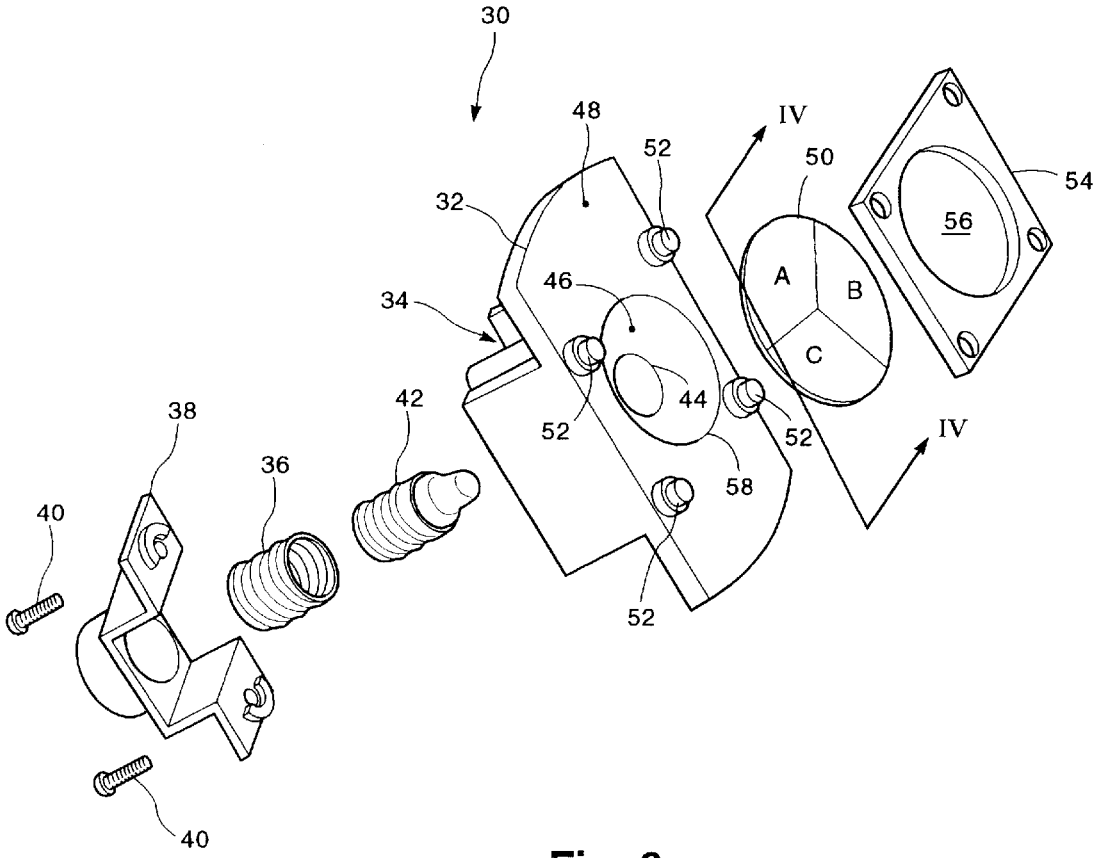
FIG. 3 is an exploded view of the internal assembly shown in FIG. 2.

The constituent parts of internal assembly 30 are shown in the exploded view of FIG. 3. Assembly 30 comprises a mounting bracket 32 which is shaped for mounting in the handle section 12. Mounting bracket 32 includes an evacuated space 34. In this space, an electrical light bulb socket 36 is mounted via a second mounting bracket 38 and screws 40 which are received in threaded holes (not shown) formed in the bracket 32. A small light bulb 42 is mounted in the socket 36 and is disposed such that the filament of the bulb extends above a hole 44 formed in the upper part of mounting bracket 32. The mounting bracket 32 also includes a parabolic light reflecting surface 46 (hereinafter "parabolic reflector") in order to direct the light produced by light bulb 42 into a well defined beam for illuminating the interior of blade section 14.

The mounting bracket 32 features a flat upper surface 48. On top of this surface 48 is disposed a translucent, multi-colored object, which is preferably a disk 50 featuring a plurality of substantially equally sized disk segments A, B, C of different colors. The disk 50 is constrained by a plurality of pins 52 which project from the mounting bracket upper surface 48. These pins define an area sized a little larger than the multi-colored disk 50 in order to permit the disk a limited motion along the transverse plane defined by upper surface 48. The disk 50 is also constrained in the axial direction by a cover 54 which is mounted to the pins 52. The cover 54 has a hole or opening 56 therein sized smaller than the disk 50 but larger enough to permit the beam of light produced by the parabolic reflector 46 to pass substantially unobstructed through the cover 54.

Figure 4B:
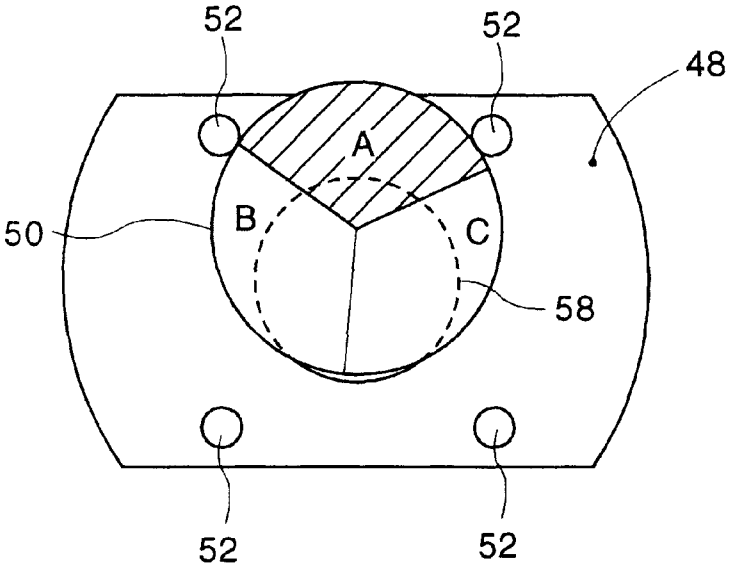
FIGS. 4A and 4B are cross-sectional views of the internal assembly, shown in FIG. 2, at various operative positions.
Figure 4A:
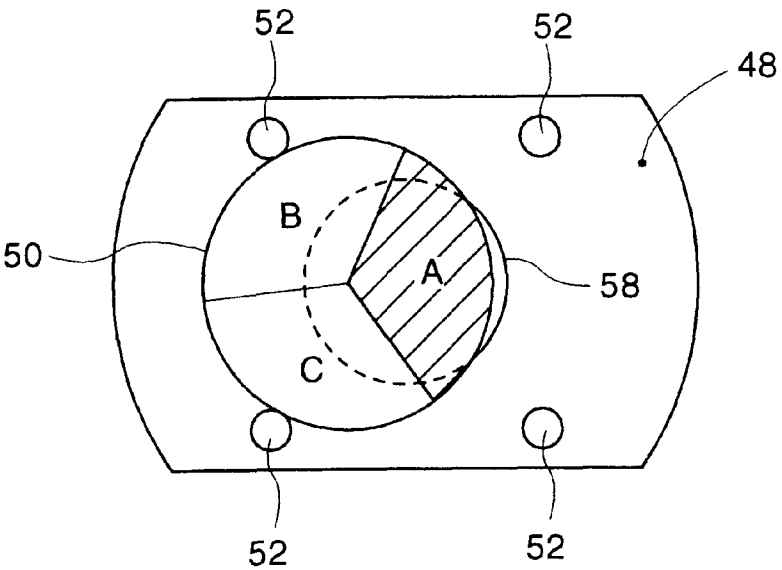

Referring additionally to the cross-sectional views of FIGS. 4A and 4B (taken along line IV—IV in FIG. 3), it will be seen that the disk 50 is sized larger than an outer end circumference 58 of the parabolic reflector 46. This outer end circumference 58 substantially defines the cross-sectional area of the light beam produced by the parabolic reflector 46 at that point. Preferably, the disk 50 is sized in the range of about 25% to 100% larger than the cross-sectional area of the light beam in order to permit any one of the tri-partite disk segments A, B, or C to substantially encompass or filter the light, as shown, for instance, in FIG. 4A. It will be seen that the multi-colored disk 50, being free to spin and having a limited transverse motion, will shift its position and orientation with respect to the light beam whenever the toy sword is agitated, thereby to vary the color of the light which illuminates the interior of blade section 14. For example, in FIG. 4A, color segment A of disk 50 substantially encompasses or filters the light beam, whereas in FIG. 4B, the disk has shifted and color segments B and C thereof substantially filter the light beam so that it is partly the color of segment B and partly the color of segment C. In the preferred embodiment, the pins 52 define a rectangular shape which, when concentric with the disk 50, has a diagonal larger than the diameter of the disk and sides which are smaller than the diameter of the disk.

Figure 5:
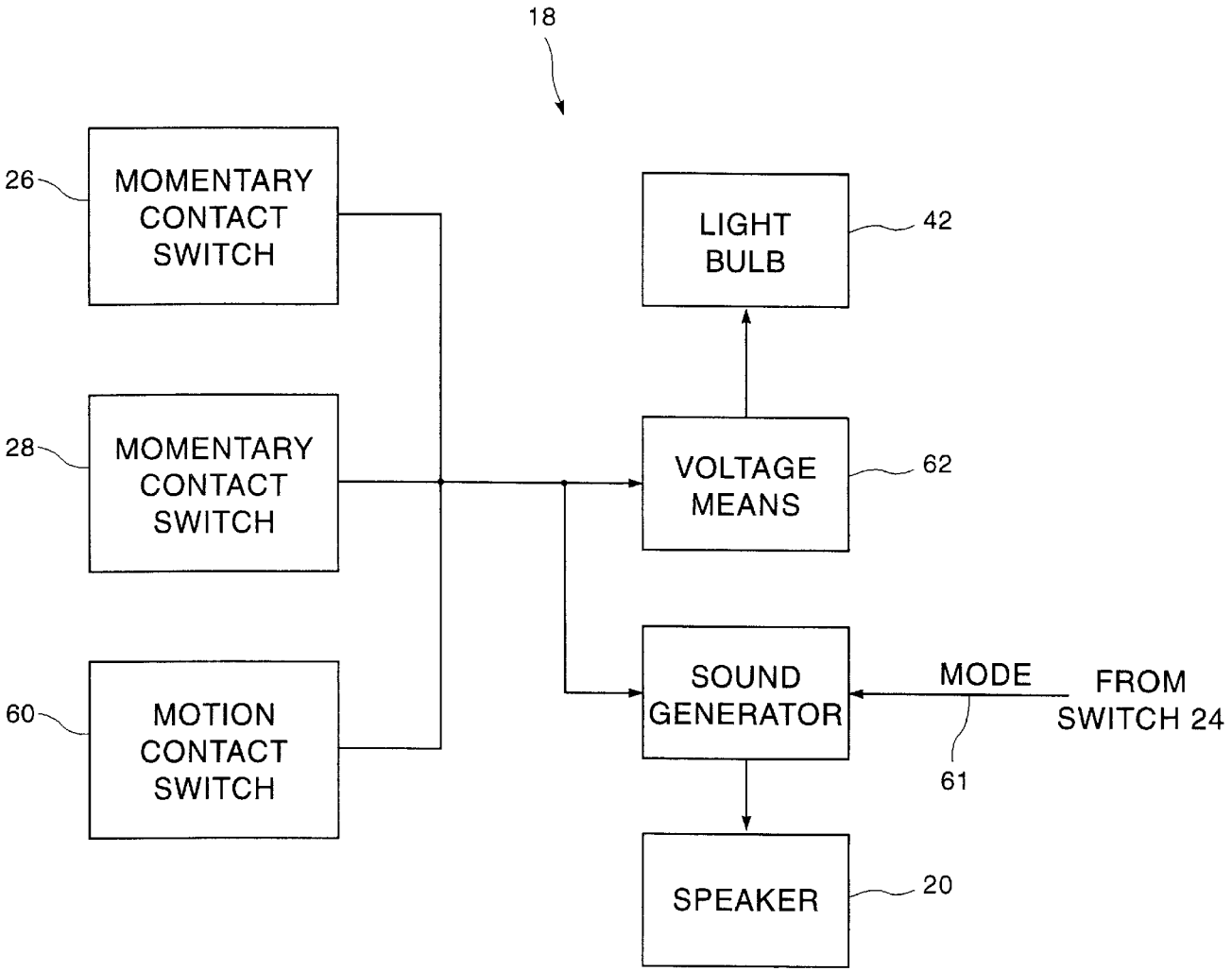
FIG. 5 is a block diagram of electric circuitry employed in the toy sword.

FIG. 5 shows, in block diagram form, the electronic circuitry 18 for energizing the light bulb 42. Switch 24 (shown also in FIG. 1) is an on/off switch which controls the application of power (source not shown) to the electronic circuitry. Switch 24 also provides a mode signal 61 to the electronic circuitry in order to control the type of acoustic effects that will be produced thereby.

In operation, the above mentioned aural and visual effects are triggered either by means of dedicated momentary contact switches 26 and 28, or alternatively, by a motion actuated switch 60. Switch 60 can be provided, for example, by a helical spring co-axial with a metallic post, wherein agitation of the toy sword causes the spring to contact the post and hence provide electrical continuity. The switches 26, 28 and 60 are connected to a known, prior art, voltage means 62 which, upon receipt of a triggering signal from any of the switches 26, 28 and 30, applies a sufficiently high voltage signal to energize the light bulb 42 for a pre-determined period of time. Preferably, the voltage applied by the voltage means 62 includes a plurality of small, low voltage, time periods for momentarily de-energizing the aforesaid light source in order to simulate flashes of lightening.

The switches 26, 28 and 60 also trigger a sound generator 64, as is known per se in the art, which, through speaker 20, produces a pre-determined acoustic effect, such as the sound of rumbling thunder, spoken words, or the sound of clanging swords, depending upon the state of the mode signal.

The voltage means 62 is known in the prior art and thus is not discussed in any detail herein. However, it will be appreciated that despite the fact that the voltage means 62 has been illustrated as a distinct circuit, numerous low cost techniques may be employed by those skilled in the art for energizing the light bulb 42. For example, a suitably buffered output signal 66 from the sound generator may be applied to the light bulb 42 to energize it. Alternatively, a dedicated timer may be used to energize the light bulb 42. Furthermore, the light bulb 42 can be connected directly to the motion activated switch 60 so that the light produced thereby will pulse in accordance with the pulsating electrical contact occurring in the motion actuating switch.

Figure 6:
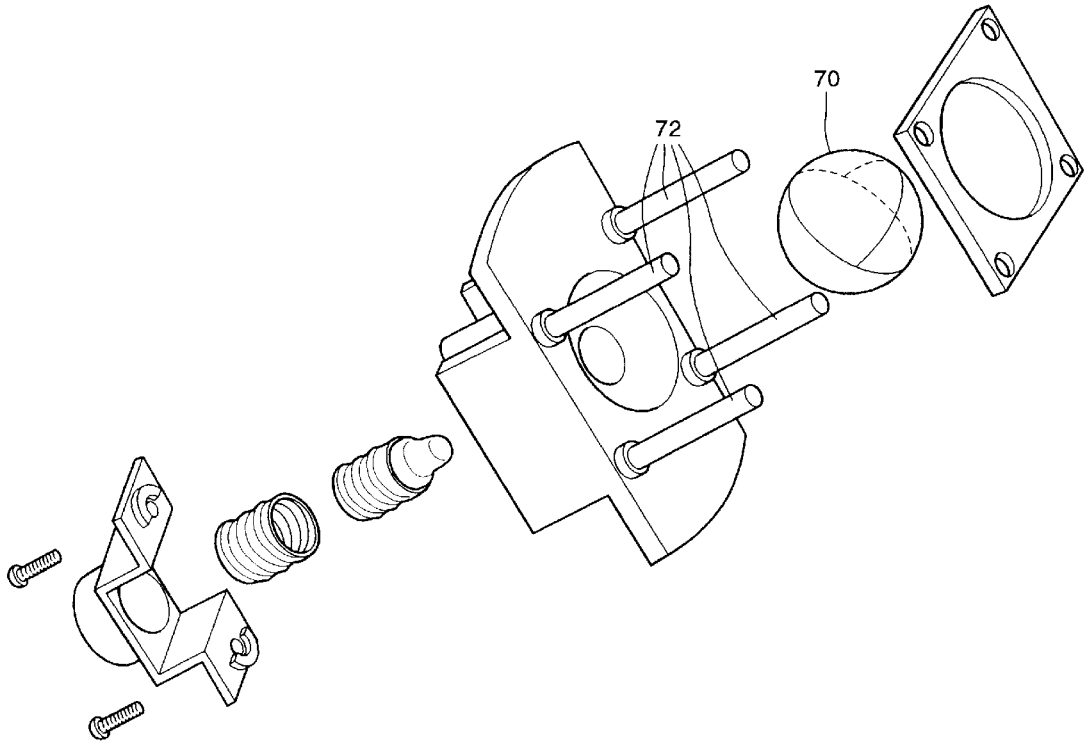
FIG. 6 is an exploded view of an alternative embodiment of the internal assembly shown in FIG. 3.

FIG. 6 shows, in an exploded view, an alternative embodiment of the internal assembly 30. In this embodiment, the translucent object is a multi-colored sphere 70 featuring a plurality of differently colored segments along approximately at least one (1) hemisphere thereof. In this embodiment, the diameter of the sphere can substantially equal the diameter of the light beam produced by parabolic reflector 46. The means for constraining the sphere 70 is similar to that shown with respect to the preferred embodiment, with the pins 52 being replaced by posts 72 which cage or mount the sphere 72 above the light source.

Irrespective of how the translucent multi-colored object is embodied, it will be appreciated that the toy sword of the invention features a blade which is illuminated by light of varying color. Moreover, the visual effects, including the variable color display, are actuated by the natural thrusting and parrying motions of sword play. These effects should greatly enhance the excitement generated by the toy sword of the invention and provide hours of fun sword play. It will also be appreciated that the improvements and enhancements to the visual experience in sword play provided by the preferred embodiment of the invention are accomplished in a most cost effective manner.

The present invention has been shown and described with reference to particular embodiments for the purposes of illustration, but not of limitation. It will be appreciated by those skilled in the art that numerous variations can be made to the embodiments described herein while still failing within the spirit and scope of the invention as defined by the claims below.

We claim:

1. A toy sword comprising:

a handle section and a translucent blade section;

said handle section housing a light source assembly for directing a light beam toward said blade section;

a translucent multi-colored object constrained to float between said light source and said blade section in the path of said light beam;

said multi-colored object being free to change its orientation relative to the light beam under agitation of said sword;

a power source connected to supply power to said light source; and at least one motion activated switch connected to control operation of said light source, said switch being operable under agitation of said sword, wherein said object is constrained by a constraint comprising an upper surface of said light source assembly, at least four pins projecting from said upper surface, and a cover plate mounted to said pins to cage said object, said cover plate having a translucent portion for permitting the light beam to shine through, and said at least four pins defining a rectangular shape having a diagonal larger than, and sides smaller than, a diameter of said object such that a portion of said object can be positioned to cross a line defined by two adjacent pins.

2. The toy sword according to claim 1 wherein said multi-colored object is disposed in said handle section.

3. The toy sword according to claim 1 wherein said sword further comprises at least one momentary contact switch operatively coupled to a timed voltage source for applying a signal to said light source for a predetermined time period in order to energize said light source.

4. The toy sword according to claim 3 wherein said voltage signal includes a plurality of small, low voltage, time periods for momentarily de-energizing said light source to produce flashes of light.

5. The toy sword according to claim 1 wherein said translucent multi-colored object is a disk featuring a plurality of disk segments of different colors, said disk being disposed substantially normal to said light beam and sized larger than a cross-sectional area thereof.

6. The toy sword according to claim 5 wherein said light source assembly comprises:

a light bulb;

an electrical socket for receiving said light bulb;

a mount for holding said socket and directing light produced by said light bulb into a beam.

7. The toy sword according to claim 5, wherein said disk is sized about 25% to 100% larger than the cross-sectional area of said light beam at said disk.

8. The toy sword according to claim 7 wherein said disk features three differently colored disk segments.

9. The toy sword according to claim 1 wherein said translucent multi-colored object is a translucent sphere wherein at least approximately one hemisphere thereof is segmented into segments of different colors.

10. The toy sword according to claim 9, wherein said sphere is approximately as wide as the cross-sectional area of said light beam.

11. A toy sword comprising:

a handle section, a translucent blade section extending therefrom and a light source assembly for illuminating the interior of said blade section, said light source assembly being housed in said handle section;

a switch for energizing a light source of said assembly;

a translucent multi-colored object disposed to filter the color of the light illuminating said blade interior; and a constraint for constraining said multi-colored object to lie in the path of the majority of the light from said light source, said light illuminating said blade section, and said multi-colored object being free to float within said constraint, whereby agitation of the toy sword varies the color of the light illuminating said blade section, wherein said constraint comprises an upper surface of said light source assembly, at least four pins projecting from said upper surface, and a cover plate mounted to said pins to cage said object, said cover plate having a translucent portion for permitting the light beam to shine through, and said at least four pins defining a rectangular shape having a diagonal larger than, and sides smaller than, a diameter of said object such that a portion of said object can be positioned to cross a line defined by two adjacent pins.

12. The toy sword according to claim 1 wherein said multi-colored object is chosen from the set of mult-colored objects consisting of:

(a) a translucent flat member featuring a plurality of differently colored segments, said flat member being larger than a cross-sectional area of the light illuminating said blade section; and (b) a translucent sphere featuring a plurality of differently colored segments, said sphere having a diameter at least substantially equal to a cross-sectional area of said light illuminating said blade section.

* * * * *